US008615101B2

(12) United States Patent
Zhang et al.

(10) Patent No.: US 8,615,101 B2
(45) Date of Patent: Dec. 24, 2013

(54) MICRO-SPEAKER

(75) Inventors: Xiong Zhang, Shenzhen (CN); San-you Wu, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 188 days.

(21) Appl. No.: 13/323,723

(22) Filed: Dec. 12, 2011

(65) Prior Publication Data

US 2012/0155696 A1 Jun. 21, 2012

(30) Foreign Application Priority Data

Dec. 21, 2010 (CN) ..... 2010 2 0676715 U

(51) Int. Cl.

*H04R 1/00* (2006.01)
*H04R 9/08* (2006.01)
*H04R 7/04* (2006.01)

(52) U.S. Cl.

CPC . *H04R 9/024* (2013.01); *H04R 7/04* (2013.01)
USPC ..... 381/412; 381/433

(58) Field of Classification Search

USPC ..... 381/396, 400, 407, 412, 431, 433; 181/198, 199

See application file for complete search history.

(56) References Cited

U.S. PATENT DOCUMENTS

| | | | | |
|---|---|---|---|---|
| 4,520,237 | A * | 5/1985 | Murakami | 381/412 |
| 6,385,328 | B1 * | 5/2002 | Yoo et al. | 381/412 |
| 2011/0110546 | A1 * | 5/2011 | Wu et al. | 381/322 |

* cited by examiner

*Primary Examiner* — Tuan D Nguyen
(74) *Attorney, Agent, or Firm* — Anova Law Group, PLLC

(57) ABSTRACT

A micro-speaker includes a frame, a yoke, a magnet, a diaphragm, and a voice coil. The yoke includes a base wall and a plurality of sidewalls defining a number of flat walls and a number of curved walls disposed at corners of the yoke. The flat walls define a number of first steps disposed at an upper level for engaging with the position blocks, the curved walls define a number of second steps disposed at a lower level for air leaking.

13 Claims, 4 Drawing Sheets

MICRO-SPEAKER

FIELD OF THE INVENTION

The present disclosure relates to the art of speakers, particularly to a micro-speaker used in an electronic device.

DESCRIPTION OF RELATED ART

Micro-speakers have been widely used in portable electronic devices in daily life and in industry, such as cellular phones, notebooks, and so on.

A related micro-speaker includes a frame, and a yoke accommodated in the frame and defining four corners. Each corner defines a step portion with a flat face for engaging with the frame. The step portion is also used for air leaking for ensuring sound quality.

The yoke is typically made from flat material by process of squeezing, tensioning and shaping. But in above process, four corners of the yoke generally suffer a larger stress than other parts thereof. The imbalanced stress leads to arching of the flat face of the step portion, and results in inexactitude and failure in assembling the frame to the rugged face of the step portion.

Therefore, it is desirable to provide a micro-speaker which can overcome the above-mentioned problems.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENT

Figure 1:
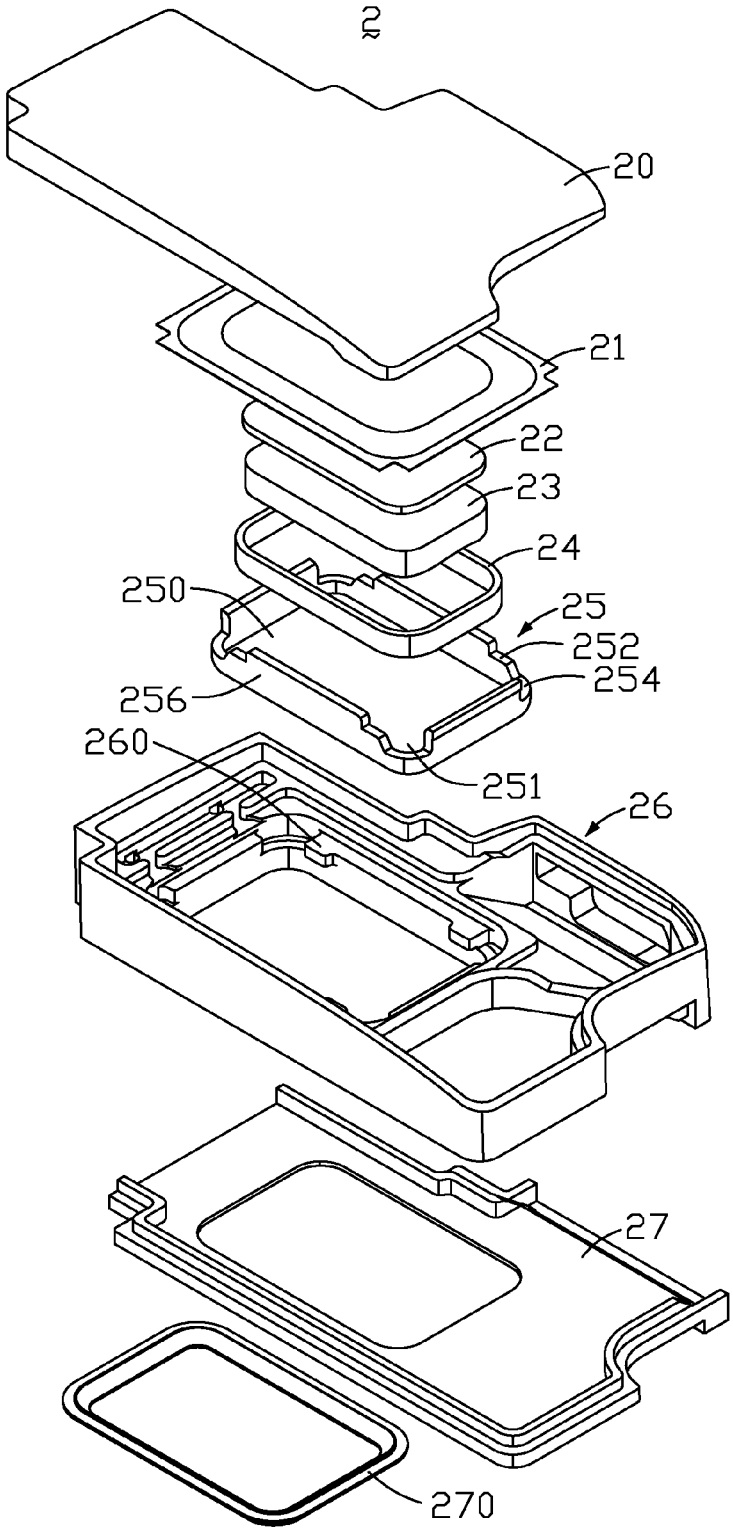
FIG. 1 is an isometric exploded view of a micro-speaker according to an exemplary embodiment of the present disclosure.
Figure 2:
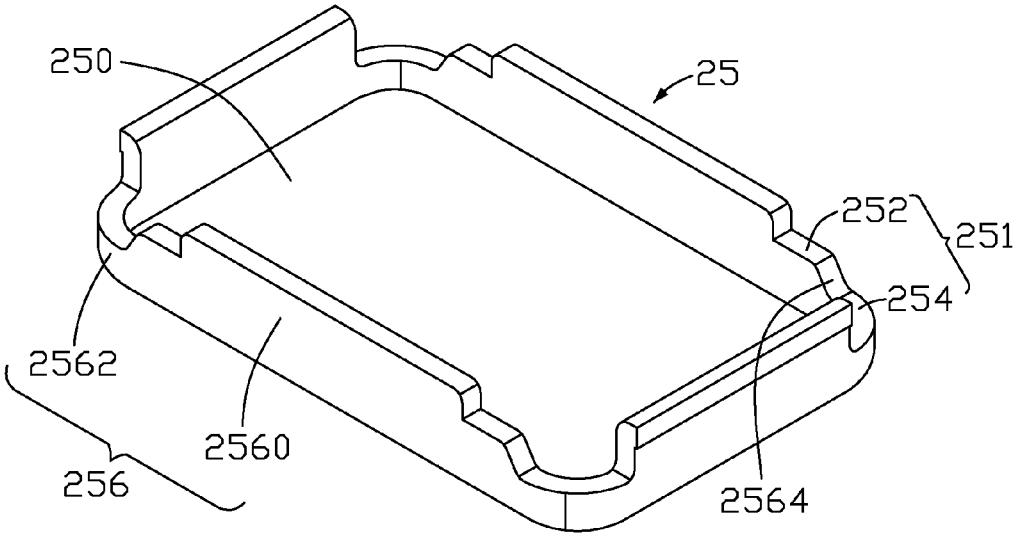
FIG. 2 is an isometric view of a yoke of the micro-speaker of FIG. 1.
Figure 3:
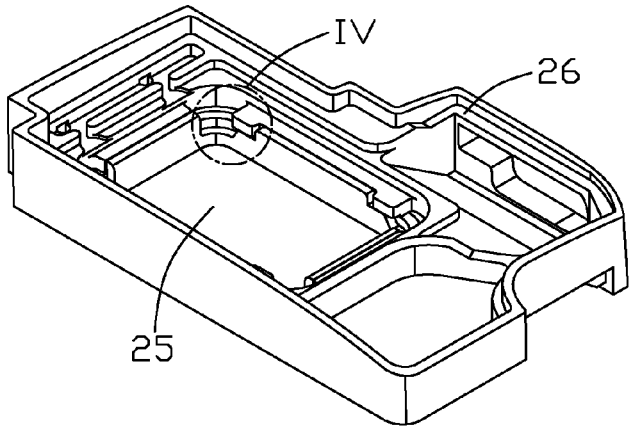
FIG. 3 is an assembled view of a combination of a yoke and a frame of the micro-speaker of FIG. 1.
Figure 4:
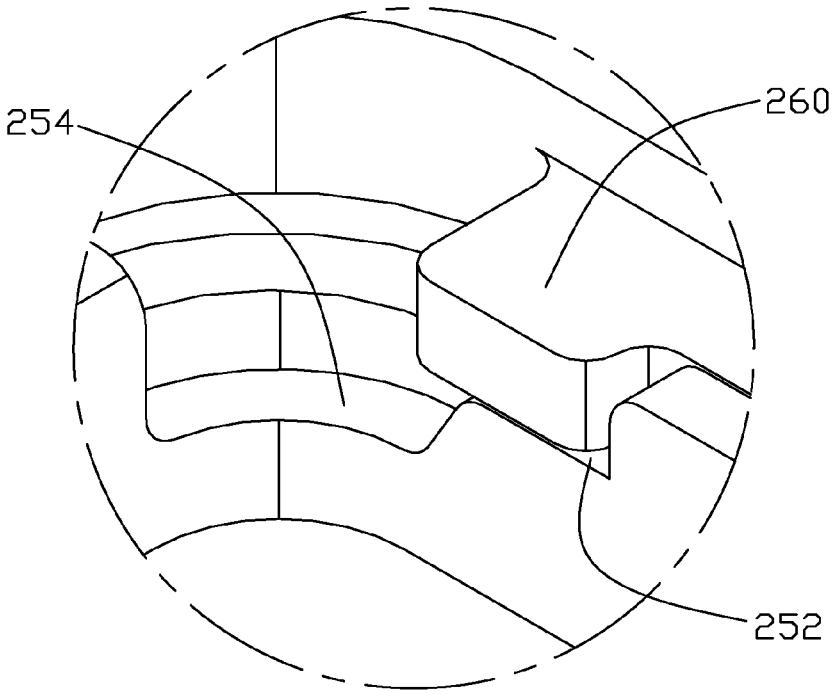
FIG. 4 is an enlarged view of part IV in FIG. 3.
Figure 5:
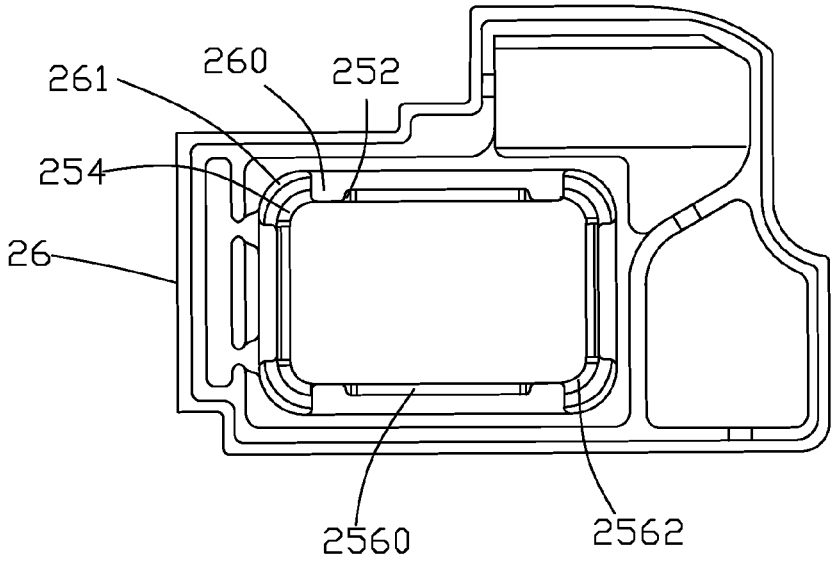
FIG. 5 is a top view of FIG. 3.
Figure 6:
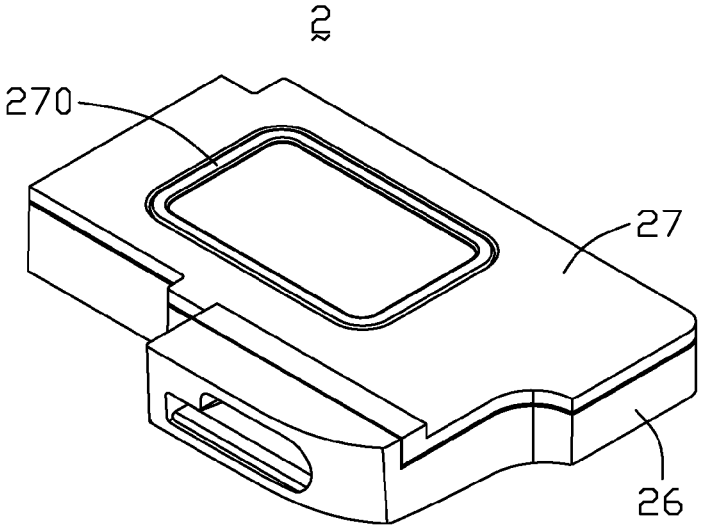
FIG. 6 is an assembled view of the micro-speaker according to the present disclosure.

Referring to FIG. 1, a micro-speaker 2 according to an exemplary embodiment includes an upper cover 20, a diaphragm 21, a pole plate 22, a magnet 23, a voice coil 24, a yoke 25, a frame 26 and a lower cover 27.

The yoke 25 includes a base wall 250, and a plurality of sidewalls 256 extending vertically from a periphery of the base wall 250 and together forming a receiving space. The sidewalls 256 include four flat walls 2560 and four curved walls 2562 each connecting two adjacent flat walls 2560. The curved walls 2562 are disposed at four corners of the yoke 25. Four outlets 251 are disposed on the upper side of the sidewalls 256, in which each outlet 251 defines a first step 252 at an upper level and a second step 254 disposed at a lower level and adjacent to the first step 252. The first step 252 is flat and disposed on the flat wall 2560. The second step 254 is disposed on the curved wall 2562. A distance from the first step 252 to the base wall 250 is longer than a distance from the second step 254 to the base wall 250. A curved surface 2564 connects the first step 252 with the second step 254. Therefore, when a strong stress generated in process of manufacturing the yoke 25 acts on the curved wall 2562, the second step 254 on the curved wall 2562 accordingly suffers a surface distortion and becomes unevenly, but the first step 253 on the flat wall 2560 keeps smooth due to little influence of a weaker stress acting on the flat wall 2560.

The frame 26 is made from plastic material and includes a plurality of walls forming a cavity for receiving the yoke 25. The frame 26 further includes four position blocks 260 extending from inner face of the walls into the cavity for engaging with the corresponding outlets 251 of the yoke 25. The position block 260 is disposed on the first step 252 so that the yoke 25 is sustained by the frame 26. The second step 253 is used for air leaking for ensuring sound quality. Apparently, a precise and stable engagement of the position block 260 and the flat first step 252 makes the micro-speaker 2 durable.

In the present embodiment, the position block 260 is partially supported by the first step 252 with the rest part thereof suspending above the second step 254. In other embodiment, the block 260 could be totally supported by the first step 252.

The magnet 23 is rectangular and disposed at a central portion of the base wall 250 of the yoke 25. The magnet 23 is made from various high rigidity metallic material, such as iron, aluminum, nickel, cobalt, cuprum, niobium, tantalum, and so on.

The pole plate 22 is disposed on an upper surface of the magnet 23. The combination of the magnet 23, the pole plate 22, and the yoke 25 serves as a magnetic circuit unit of the micro-speaker 2.

The voice coil 24 is disposed in a magnetic gap formed by the sidewalls 256 of the yoke 25 and the magnet 23 with one end attached to a surface of the diaphragm 21. The combination of the voice coil 24 and the diaphragm 21 serves as a vibrating unit of the micro-speaker 2.

The frame 26 is disposed between the upper cover 20 and the lower cover 27 and defines four holes 261 used to aerate. The lower cover 27 includes a bottom plate 270 mounted to the yoke 25.

It will be understood that the above-mentioned particular embodiment is shown and described by way of illustration only. The principles and the features of the present disclosure may be employed in various and numerous embodiments thereof without departing from the scope of the disclosure as claimed. The above-described embodiment illustrates the scope of the disclosure but do not restrict the scope of the disclosure.

What is claimed is:

1. A micro-speaker, comprising:

a frame including a plurality of walls forming a cavity and a plurality of position blocks extending from inner face of the walls into the cavity;

a yoke received in the cavity, including a base wall and a plurality of sidewalls extending vertically from a periphery of the base wall, the sidewalls defining a plurality of flat walls and a plurality of curved walls disposed at corners of the yoke;

a magnet disposed at a central portion of the base wall and forming a magnetic gap corporately with the yoke;

a diaphragm;

a voice coil disposed in the a magnetic gap for driving the diaphragm; wherein the flat wall defines a first step disposed at an upper level for engaging with the position blocks of the frame, the curved wall defines a second step disposed at a lower level for air leaking.

2. The micro-speaker as claimed in claim 1, wherein the yoke is substantially rectangular and includes four flat walls and four curved walls each connecting two adjacent flat walls.

3. The micro-speaker as claimed in claim 2, wherein the first step is adjoined the second step, and a distance from the first step to the base wall of the yoke is longer than a distance from the second step to the base wall.

4. The micro-speaker as claimed in claim 3, wherein each position block cooperates with the first step.

5. The micro-speaker as claimed in claim 1, wherein the micro-speaker is provided with an upper cover and a lower cover with the frame disposed therebetween.

6. The micro-speaker as claimed in claim 5, wherein the lower cover includes a bottom plate mounted to the yoke.

7. A micro-speaker, comprising:

a frame with a plurality of position blocks;

a magnetic circuit unit accommodated in the frame, including a yoke with a base wall and a plurality of sidewalls extending vertically from the base wall, a magnet disposed on the base wall and forming a magnetic gap corporately with the sidewalls;

a vibrating unit including a diaphragm and a voice coil connected with the diaphragm; wherein a plurality of outlets are disposed on an upper side of the sidewalls, each outlet defining a first step disposed at an upper level for supporting the position block and a second step adjoined with the first step and disposed at a lower level.

8. The micro-speaker as claimed in claim 7, wherein the sidewalls includes four flat walls and four curved walls, each curved wall connecting two adjacent flat walls.

9. The micro-speaker as claimed in claim 8, wherein the first steps are disposed on the flat walls, the second steps are disposed on the curved walls.

10. The micro-speaker as claimed in claim 9, wherein a curved surface is disposed between each first step and second step.

11. The micro-speaker as claimed in claim 10, wherein each position block is partially supported by the first step with the rest part thereof suspending above the second step.

12. A micro-speaker, comprising:

a frame including a plurality of walls forming a cavity and a plurality of position blocks extending from inner face of the walls into the cavity;

a yoke accommodated in the cavity, including a base wall and a plurality of sidewalls extending vertically from a periphery of the base wall, the sidewalls defining a plurality of flat walls and a plurality of curved walls, each curved wall connecting two adjacent flat walls and disposed at a corner of the yoke, the flat walls defining a plurality of first steps at an upper level for engaging with the position blocks, the curved walls defining a plurality of second steps at a lower level.

13. The micro-speaker as claimed in claim 12, wherein the frame includes four position blocks disposed on the first steps.

* * * * *